US008744294B2

(12) United States Patent
Noguchi et al.

(10) Patent No.: US 8,744,294 B2
(45) Date of Patent: Jun. 3, 2014

(54) ELECTROPHOTOGRAPHIC IMAGE FORMING APPARATUS WITH IMAGE DENSITY CONTROL

(75) Inventors: Akihiro Noguchi, Toride (JP); Fumitake Hirobe, Ushiku (JP); Shigeru Tanaka, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 118 days.

(21) Appl. No.: 13/354,793

(22) Filed: Jan. 20, 2012

(65) Prior Publication Data

US 2012/0207496 A1 Aug. 16, 2012

(30) Foreign Application Priority Data

Feb. 10, 2011 (JP) ..... 2011-027155

(51) Int. Cl.
*G03G 15/00* (2006.01)

(52) U.S. Cl.
USPC ..... 399/49; 399/55; 399/72

(58) Field of Classification Search
USPC ..... 399/49
See application file for complete search history.

(56) References Cited

U.S. PATENT DOCUMENTS

| | | | | |
|---|---|---|---|---|
| 6,147,698 | A * | 11/2000 | Zable et al. | 347/240 |
| 6,226,466 | B1 * | 5/2001 | Ojima et al. | 399/49 |
| 7,269,362 | B2 * | 9/2007 | Hama et al. | 399/27 |
| 7,920,801 | B2 * | 4/2011 | Otsuka et al. | 399/55 |
| 2004/0165899 | A1 * | 8/2004 | Chigira | 399/49 |
| 2005/0063721 | A1 * | 3/2005 | Nakayama et al. | 399/49 |
| 2006/0165426 | A1 * | 7/2006 | Shimura et al. | 399/49 |
| 2009/0202263 | A1 * | 8/2009 | Yoshida et al. | 399/49 |

FOREIGN PATENT DOCUMENTS

| | | | |
|---|---|---|---|
| JP | 05-323780 | A | 12/1993 |
| JP | 09-034243 | A | 2/1997 |
| JP | 3171345 | B2 | 5/2001 |
| JP | 2004-177928 | A | 6/2004 |
| JP | 2006-017918 | A | 1/2006 |
| JP | 4433698 | B2 | 3/2010 |
| JP | 2010-276625 | A | 12/2010 |
| JP | 4608968 | B2 | 1/2011 |
| JP | 2011-107630 | A | 6/2011 |

* cited by examiner

*Primary Examiner* — David Gray
*Assistant Examiner* — Geoffrey Evans
(74) *Attorney, Agent, or Firm* — Fitzpatrick, Cella, Harper & Scinto

(57) ABSTRACT

A representative configuration of an image forming apparatus has a plurality of developing devices, each of which develops an electrostatic latent image formed on a photosensitive drum into a toner image using developer of plural colors. The image forming apparatus includes a density sensor which detects the amount of toner of the toner image for each color. In a case where it is determined that the amount of toner of any color departs from a predetermined range based on the detection result of the density sensor, development conditions of the rest of the developing devices, other than the developing device departing from the predetermined range, are changed such that the image densities developed by the respective developing devices are equal to each other.

1 Claim, 6 Drawing Sheets

ELECTROPHOTOGRAPHIC IMAGE FORMING APPARATUS WITH IMAGE DENSITY CONTROL

BACKGROUND OF THE INVENTION

1. Field of the Invention

The present invention relates to an image forming apparatus which forms an image using an electrophotographic system.

2. Description of the Related Art

An image forming apparatus according to the related art forms a color image using toner of four colors of yellow, magenta, cyan, and black. As a developer, a two-component developer is used which contains nonmagnetic toner particles (toner) and magnetic carrier particles (carrier). Japanese Patent Laid-Open No. 2004-177928 and Japanese Patent Laid-Open No. 9-34243 disclose a color image forming apparatus in which the colors of an output material are stabilized by stabilizing the density of each color.

An image density gradually changes as the number of printed sheets increases. However, the level of the change is influenced by the contents of the formed image as well as by the number of printed sheets of the formed image. For example, an image with a relatively high density in which a lot of solid portions occur or which contains a large number of characters, and an image with a relatively low density which contains fine lines or a small number of characters are greatly different in toner consumption even when the number of formed images is the same.

In Japanese Patent Laid-Open No. 2004-177928, a small image (patch image) for a test is formed on the image bearing member at a timing based on toner consumption information and then density control factors influencing the density of the image are optimized based on the density of the patch image.

Further, in a case where images consuming little amount of toner are continuously output, the replacement of the toner is performed occasionally, so that the developer is repeatedly rubbed and stirred for a long term. The toner contained in the developer which has been repeatedly rubbed and stirred for a long term may have an irregular shape, or the distribution of the particle diameter is biased. In addition, an external additive such as titanium oxide particles which is added for the purpose of improving fluidity of the developer is implanted in the surface of toner. As a result, there may be degradation such as a decrease in the fluidity of the developer, and thus it is difficult to obtain an image having a desired image quality.

In addition, even though the electric charges of the toner are stabilized through several times of slidable rubbing, as several times of slidable rubbing are repeated, the electric charges are gradually increased, so that the electric charge amount becomes greater than a predetermined value. In this way, if the electric charges of the toner are increased, the amount of toner adhered on a latent image having the same potential difference with respect to a developing sleeve which is formed on the photosensitive drum is reduced compared with an initial state. When an image is output, the density is deteriorated and granularity of the low density portion is worsened, so that the image quality is degraded.

In addition, in a case where the density of the output image is reduced due to degradation in the developer with time, the densities of colors are separately adjusted while securing a maximum density by changing conditions such as a charging potential or a developing bias, power of laser beams, or time for emitting laser beams. In order to secure the maximum density, it is necessary to increase a difference potential (hereinafter, referred to as a contrast potential) between a potential VL of an image area and an average potential of potentials Vdc applied to the developing sleeve.

Further, in Japanese Patent Laid-Open No. 9-34243, a decrease in the density which occurs when the toner consumption is reduced is suppressed by forcibly replacing the toner in a development device.

However, in Japanese Patent Laid-Open No. 2004-177928 and Japanese Patent Laid-Open No. 9-34243, the density of each color is stabilized with an individual countermeasure about the development device for each color of yellow, magenta, cyan, or black, thereby making the color of the output material stabilized. For example, in a case where the density is increased only in a development device of a given color, when the density is corrected such that the increased density of the development device becomes equal to those of the other normal development devices, it is necessary to lower the contrast potential of the development device which has been changed in the density. However, if the contrast potential of only the development device which has been changed in the density is lowered to depart from a predetermined range, the development γ (the development performance with respect to the development potential) of the development device becomes too strong. In other words, a large amount of the toner is consumed at a small contrast potential. For this reason, in a case where the potential of the photosensitive drum is changed in the surface thereof, the variation ratios of the densities of high-order colors such as a second-order color of red, blue, or green are different in each color, so that a color tone of an image having high-order colors varies.

In addition, in a case where the density is reduced only in a development device of a given color, when the density is corrected such that the reduced density of the development device becomes equal to those of the other normal development devices, it is necessary to increase the contrast potential. However, in a case where the contrast potential is greatly increased, an adverse effect such as carrier attachment occurs on an image.

In this manner, in a case where the density variation occurs in one development device, if a process is performed to correct the density of the development device in which the density variation occurs, the density correction process may lead to a problem.

SUMMARY OF THE INVENTION

The present invention provides an image forming apparatus, which can suppress carrier attachment caused when the density of one development device is corrected so as to be equal to those of the other development devices or can suppress the variation of a color tone of an image having high-order colors caused when the variation ratios of the densities of colors are different from each other.

The image forming apparatus includes a plurality of image forming portions, each being provided with a developing device having a developer carrier for developing an electrostatic latent image, a sensor that detects a toner image for control formed by each of the image forming portions, and a controller that controls a potential difference between a developing bias applied to the developer carrier of each of the image forming portions and a potential of a maximum image density portion of an electrostatic latent image to be developed by each of the developing devices such that a density of the toner image for control formed by each of the image forming portions is a predetermined target density range wherein the controller changes the predetermined target density such that the potential difference set by each of the image forming units is in a predetermined range.

Further features of the present invention will become apparent from the following description of exemplary embodiments with reference to the attached drawings.

DESCRIPTION OF THE EMBODIMENTS

First Embodiment

Figure 1:
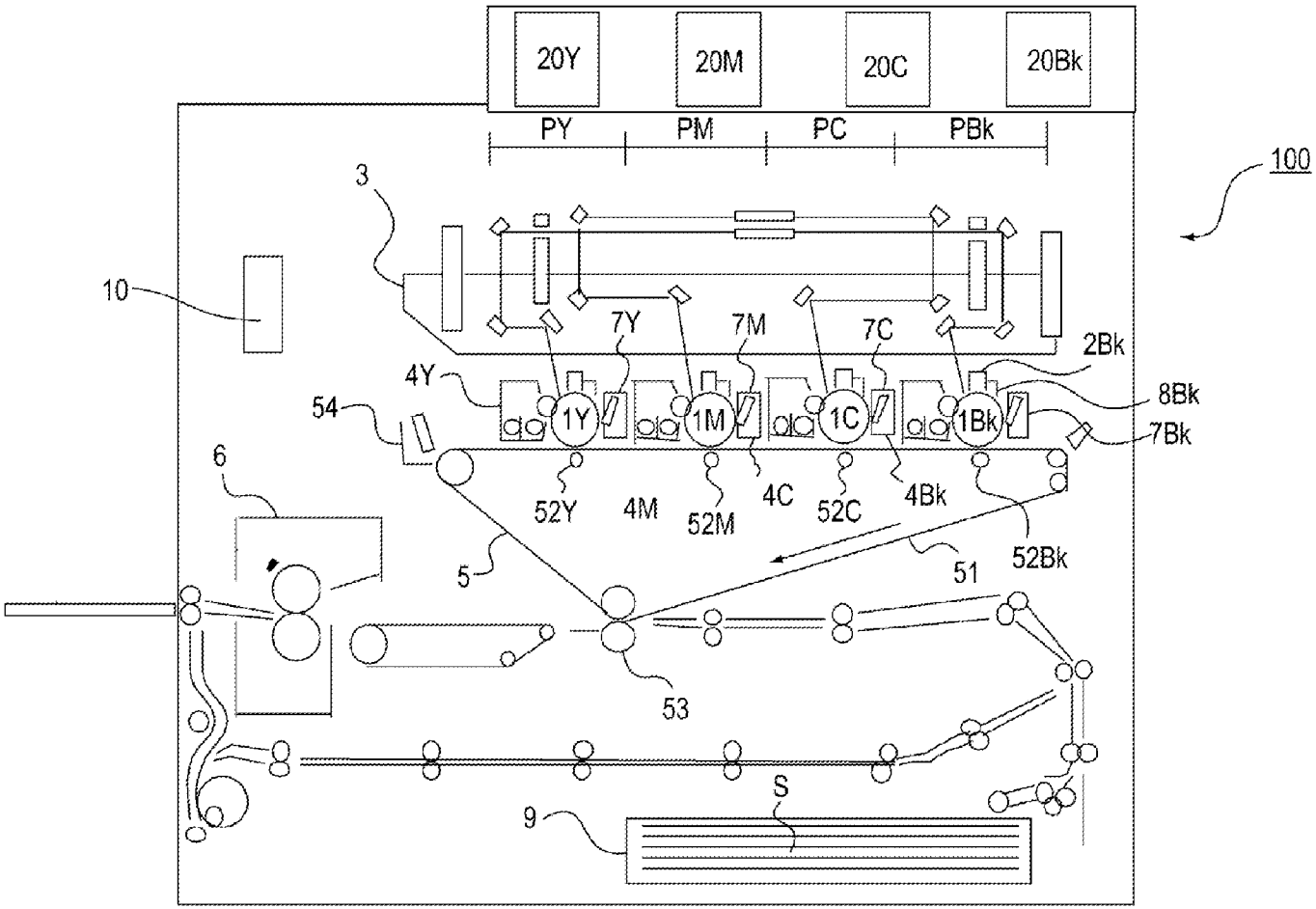
FIG. 1 is a diagram illustrating a configuration of an image forming apparatus according to a first embodiment.

An image forming apparatus according to a first embodiment of the invention will be described with reference to the drawings. FIG. 1 is a diagram illustrating an image forming apparatus 100 according to this embodiment. As illustrated in FIG. 1, the image forming apparatus 100 includes first to fourth image forming portions PY, PM, PC, and PBK, which form color images of yellow, magenta, cyan, and black, respectively. The configurations of the respective image forming portions PY to PBK are substantially equal to each other excepting development colors. Therefore, in a case where it is not necessary to distinguish the portions from each other in the following, the description will be made as a whole without assigning the suffixes Y, M, C, and K to symbols for indicating which element belongs to a given image forming portion.

The image forming portion P includes a photosensitive drum (image bearing member) 1, a charger (charging portion) 2, an exposure device (exposure unit) 3, a developing device (developing unit) 4, a transfer device (transfer portion) 5, a cleaning device (cleaning unit) 7, a charge removal device (the charge removal portion) 8, a controller 10, and a primary transfer member 52. The transfer device 5 includes an intermediate transfer belt (intermediate transfer member) 51.

The photosensitive drum 1 is charged by the charger 2 and exposed to light by the exposure device 3 according to image information signals, so that an electrostatic latent image is formed thereon. The electrostatic latent image formed on the photosensitive drum 1 is developed as a toner image by the developing device 4 using a two-component developer having a plurality of colors. At this time, the two-component developer is supplied from a hopper 20 to the developing device 4 according to an amount of the consumed toner. The two-component developer contains nonmagnetic toner particles (toner) and magnetic carrier particles (carrier). The respective colors of the toner images formed on the photosensitive drum 1 are primarily transferred onto the intermediate transfer belt 51 (the intermediate transfer member) so as to be overlapped with each other at a primary transfer nip portion (primary transfer portion) N1 in which the intermediate transfer belt 51 is interposed between the photosensitive drum 1 and the primary transfer member 52.

On the other hand, a sheet S stored in a cassette (sheet container) 9 is conveyed to a secondary transfer nip portion (secondary transfer portion) N2, in which the intermediate transfer belt 51 and a secondary transfer member 53 abut, by a sheet conveying member such as a pickup roller, a conveying roller, and a registration roller. The sheet S conveyed to the secondary transfer nip portion N2 is secondly transferred with the respective colors of the toner images, heated and pressed by a fixing device 6 to fix the toner images thereon, and then discharged to the outside of the main apparatus body.

After the primary transfer, extraneous matter such as residual toner on the photosensitive drum 1 (image bearing member) is recovered by the cleaning device 7. Then, the photosensitive drum 1 is prepared to perform the next image forming process. After the secondary transfer, extraneous matter such as residual toner on the intermediate transfer belt 51 is removed by an intermediate transfer member cleaner 54.

(Image Density Measuring Method)

Figure 2A:
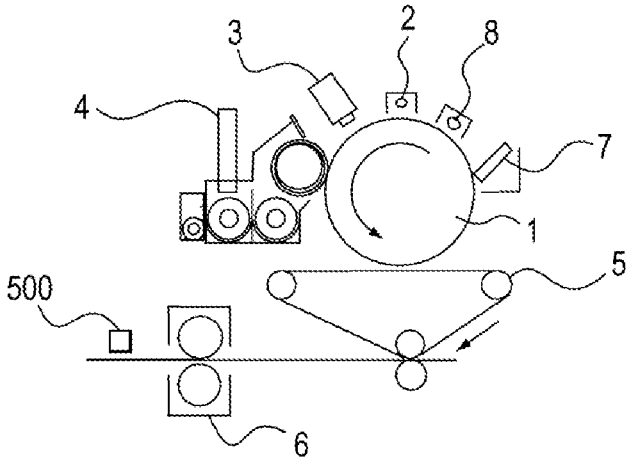
FIG. 2A is a diagram illustrating the configuration of the image forming apparatus according to the first embodiment.

As illustrated in FIG. 2A, the image forming apparatus 100 includes a density sensor (toner quantity detecting unit) 500 on the downstream side in the conveying direction of the sheet from the fixing device 6. The density sensor 500 measures the density of the gray-scaled image which is formed on the sheet S passed through the fixing device 6.

Figure 2B:
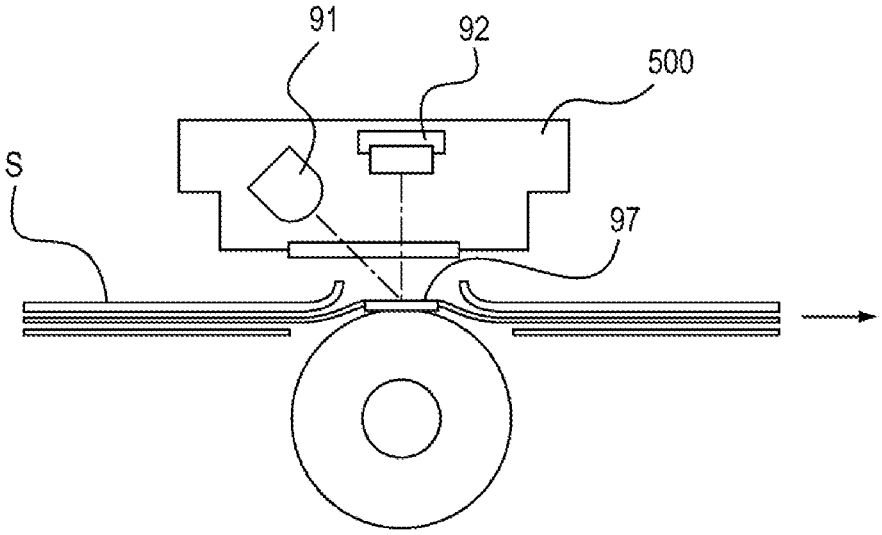
FIG. 2B is a diagram illustrating a configuration of a density sensor according to the first embodiment.
Figure 2C:
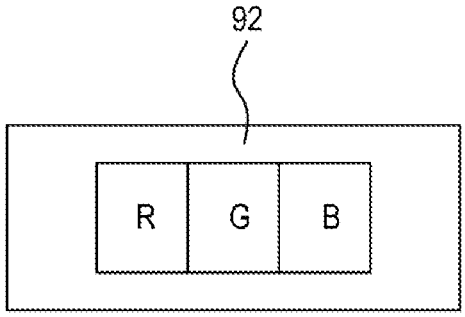
FIG. 2C is a diagram illustrating an image model of a light-receiving portion of a charge accumulating sensor according to the first embodiment.

As illustrated in FIG. 2B, the density sensor 500 includes a white LED (irradiation unit) 91 and a charge accumulating sensor (light-receiving unit) 92 which is provided with an on-chip RGB filter. The white LED 91 emits light to the sheet S in a tilted angle by 45 degrees. The charge accumulating sensor 92 detects the intensity of diffused reflection light on a small image (patch) 97 for a test formed on the sheet S in a direction of 0 degree. As illustrated in FIG. 2C, the light-receiving portion of the charge accumulating sensor 92 is provided with pixels having RGB separated from each other. The colors of CMYK can be identified or the densities (the toner quantities of the respective colors) can be detected based on the three different RGB outputs obtained by the light-receiving portion of the charge accumulating sensor 92. In addition, chromaticity can be also detected by processing the RGB outputs through a mathematical process such as linear transformation or by converting the RGB outputs using a lookup table (LUT).

The amount of accumulated charges is adjusted by arbitrarily varying the output power of the LED or an accumulation time period so as to obtain a desired dynamic range. Further, by performing the above adjustment using indexes prepared in advance, the density of toner on the sheet S can be measured with high precision based on the reflection light quantity.

In addition, the charge accumulating sensor may be a photodiode. The charge accumulating sensor may be configured to include a plurality of the sets that each include three RGB pixels. Further, the charge accumulating sensor may be configured such that an incident angle is 0 degrees and the reflection angle is 45 degrees. Furthermore, the charge accumulating sensor may be configured with an LED emitting three RGB colors and a sensor having no filter therein.

(Image Density Changing Control in the Related Art)

Figure 6:
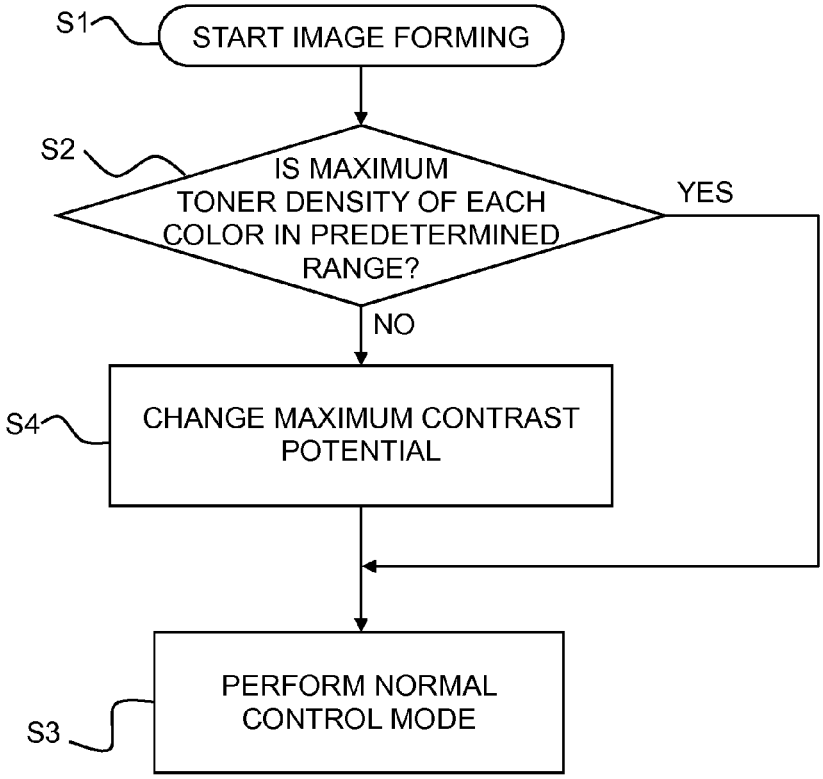
FIG. 6 PRIOR ART
FIG. 6 is a flowchart illustrating an image density control according to the related art.

FIG. 6 is a flowchart illustrating an image density control according to the related art. As illustrated in FIG. 6, when an image forming process starts in Step S1, the patch 97 is formed at a timing based on toner consumption information. Then, the image densities of the respective colors of the patch 97 are detected by the density sensor 500, and then it is determined whether or not the maximum image density of each color is in a predetermined value range in Step S2. The predetermined value range of the maximum image density is assumed to be a range of ±0.08 with respect to the maximum image density of 1.6 which is a value set at the initial stage of the image forming process. This is because, in a case of $\Delta E \leq 3$, the human eyes cannot recognize the variation of a color tone.

In a case where the maximum image densities of the respective colors are in the predetermined range, a normal control mode is performed in which the density control factors influencing the density of an image are optimized based on the density of the patch 97 in Step S3. In a case where the maximum image density of any color is not in the predetermined range, it is recognized that the color tone may vary if the image density varies furthermore. For this reason, the normal control mode is performed in Step S3 such that the maximum contrast potential of the corresponding color is changed to make the maximum image density fall in the predetermined range in Step S4. The contrast potential means a differential potential (potential difference) between the potential VL of an image area on the photosensitive drum 1 and an average potential of the potentials Vdc applied to the development sleeve (development unit) of the developing device 4.

However, when the developer starts to be degraded, the predetermined image density may not be achieved unless the maximum contrast potential is not increased significantly. In this case, by making the maximum contrast potential increased, an amount of charges are injected from the carrier to the photosensitive drum 1. Therefore, a reflection force between the carrier and the photosensitive drum 1 increases, and the carrier is easily attached on the photosensitive drum 1. When the carrier attached on the photosensitive drum 1 is transferred onto the sheet S, a black spot is generated in the white portion of an image, so that the image quality is remarkably degraded. In order to prevent the degradation in the image quality, the variation amount of the maximum contrast potential is set to have a limit. However, once the variation amount reaches the limit, the maximum image density cannot be secured. Further, this phenomenon may not be an issue if it simultaneously occurs over all the colors. However, the phenomenon causes a difference in the degradation of the developer for each color due to a difference in an image ratio for each color of the image to be formed or due to a change with time. In addition, a difference in the development performance is caused due to the variation of a toner triboelectric-charge quantity. For this reason, the variation of a hue becomes greater in an image having high-order colors, and thus it is easily recognized that the color tone is changed.

(Control for Changing Image Density in this Embodiment)

In this embodiment, in a case where it is necessary to change the maximum contrast potential to be out of the limit in order to confine the image density in a predetermined range, a color tone stabilizing mode is performed to change the image density to be equal to that of yellow having the lowest image density exceeding the predetermined range. With this mode, an abnormal image caused by fogging, carrier attachment, or the like is not generated, and a change in a color tone can be suppressed to be small. Hereinafter, the control for changing the image density which is performed by the controller 10 of this embodiment will be specifically described. The controller 10 receives a detection result from the density sensor 500 and adjusts the contrast potentials (developing condition) for the photosensitive drum 1 and the developing device 4 of each color, thereby adjusting the image density.

Figure 3:
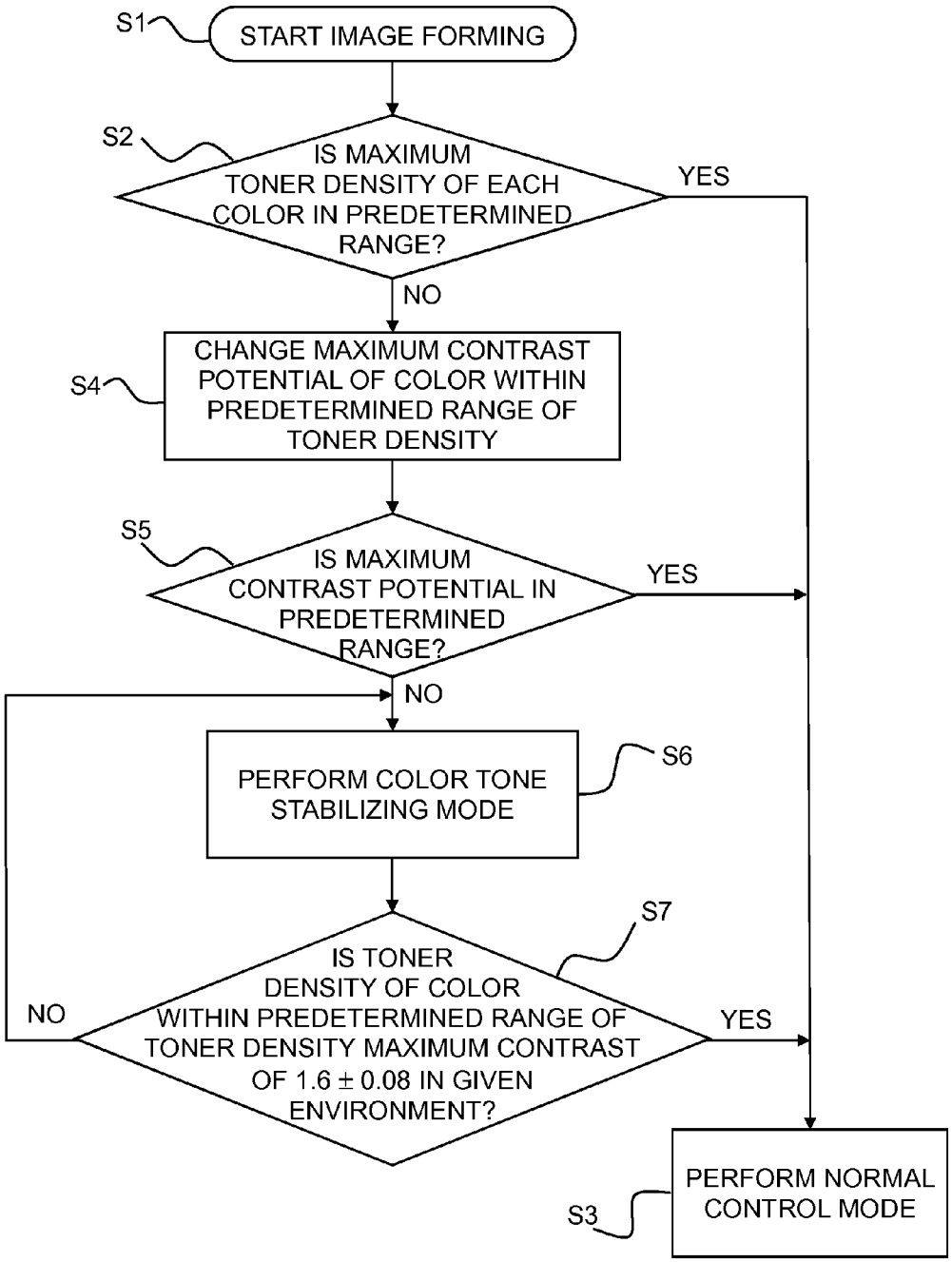
FIG. 3 is a flowchart illustrating an image density control according to this embodiment.

FIG. 3 is a flowchart illustrating the control for changing the image density according to this embodiment. As illustrated in FIG. 3, when image formation starts in Step S1, a toner image is formed for controlling the maximum image density for each color at a predetermined timing. Then, the toner image for controlling the maximum image density for each color is detected by the density sensor 500. The controller 10 determines in Step S2 whether or not the toner image for controlling the maximum image density for each color is in a predetermined value range, based on the detection result of the density sensor 500. The predetermined value range of the maximum image density is set to a range of ±0.08 with respect to the maximum image density of 1.6 which is set at the initial stage of the image formation. This is because, in a case of $\Delta E \leq 3$, the human eyes cannot recognize the variation of a color tone.

In a case where the maximum image densities of the respective colors are in the predetermined range, a normal control mode is performed in Step S3. In a case where the maximum image density of any one of colors does not fall within the predetermined range, the controller 10 changes the maximum contrast potential of colors other than the color departing from the predetermined range such that the respective maximum image density of each of the other colors falls within the corresponding predetermined range in Step S4. Then, the controller 10 determines whether or not a change in the maximum contrast potential is made in the predetermined range in Step S5. The predetermined range of the change in the maximum contrast potential is set to be a range of ±20% with respect to the optimal maximum contrast potential under a given environment.

In a case where the change in the maximum contrast potential falls within the predetermined range, the normal control mode is performed in Step S3. In a case where the change in the maximum contrast potential does not fall within the predetermined range, the controller 10 performs the color tone stabilizing mode in Step S6, so that the maximum contrast potential of colors other than the color departing from the predetermined range is changed to make the image density be equal to the lowest image density of the color departing from the predetermined range.

Figure 4:
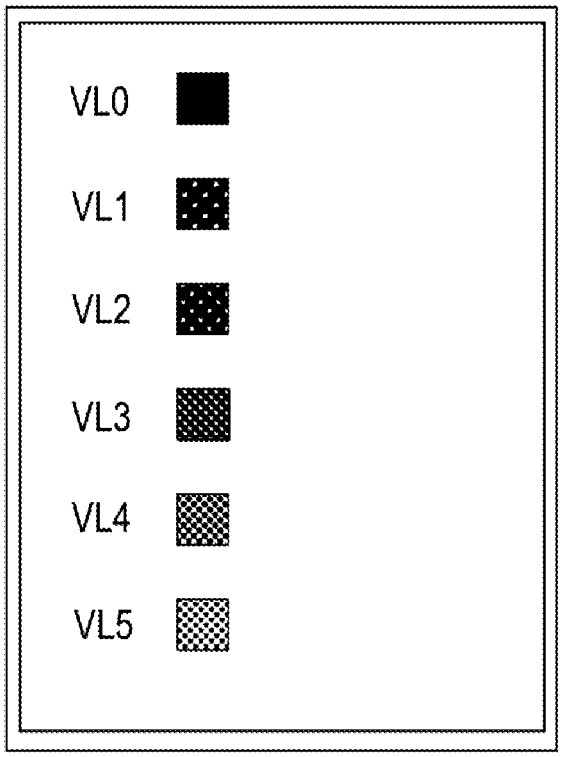
FIG. 4 is a diagram illustrating a test pattern according to the first embodiment.

When the color tone stabilizing mode is selected, the test patterns VL0 to VL5 at a density data level FFH (see FIG. 4) are formed on the sheet S for each color. The test patterns VL0 to VL5 are formed using laser power such that the contrast potentials thereof are lowered from the currently set maximum contrast potential down to 50 V in the unit of 10 V. The amount of toner of each of the test patterns VL0 to VL5 is detected using the density sensor 500. The densities of colors are changed to be equal to the lowest density of color based on the detected density data. With respect to halftone data (00H to FEH), a known test pattern for tone correction is detected, and a tone correction table is updated, thus the linearity of the halftone can be secured. An output material at this time is discharged to an escape tray (not illustrated in the drawing).

Then, in Step S7, when the color in which the change in the maximum contrast potential does not fall within the predetermined range has the maximum image density of 1.6, the process returns to the normal control of Step S3.

As described above, with the control for changing the image density according to this embodiment, the occurrence of an abnormal image is suppressed, and the variation ratio of the density for each color becomes constant, so that it can be prevented that the color tone is recognized as it is changed.

The description has been made in connection with the case where the density becomes lowered. However, on the contrary, in a case where the density becomes higher, if the maximum contrast potential is lowered to depart from the predetermined range, the development γ (the development performance with respect to the development potential) becomes too strong. In other words, since a large amount of the toner is consumed at a small contrast potential, an error in the potential on the photosensitive drum causes a great influence on the change in a color tone.

Similarly to the case where the density becomes lowered, the color tone stabilizing mode is performed to make the image densities of colors be equal to the highest image density of the color departing from the predetermined range. Therefore, the variation of the color tone can be suppressed.

In addition, the colors of toner or the number of the colors, the order of the colors in which the toner images are developed, the place, the position, and the number of points where the density data is measured, a threshold value at which the process enters the color tone stabilizing mode, and a threshold value at which the process returns to the normal control mode are not limited to this embodiment.

Second Embodiment

Next, an image forming apparatus according to a second embodiment of the invention will be described with reference to the drawings. As for part of the second embodiment for which the description is already given regarding the first embodiment, that part is denoted by the same reference numerals and is not be redundantly described.

Figure 5A:
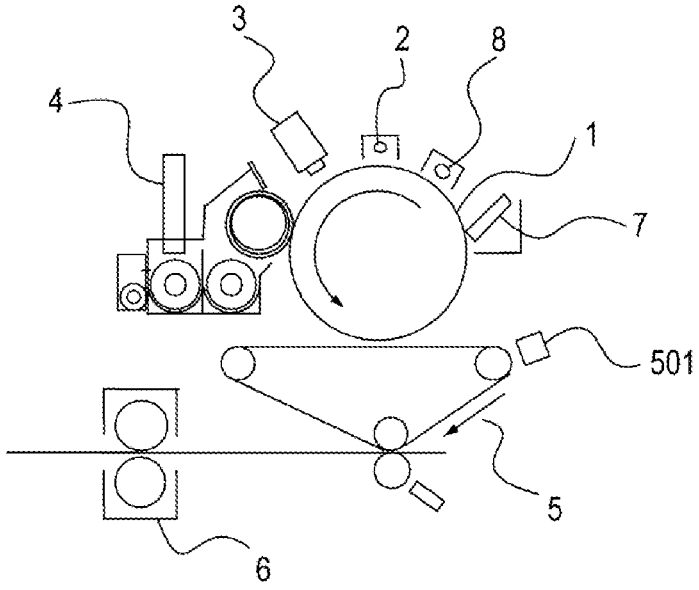
FIG. 5A is a diagram illustrating a configuration of an image forming apparatus according to a second embodiment.

FIG. 5A is a diagram illustrating the configuration of the image forming apparatus according to this embodiment. As illustrated in FIG. 5A, the image forming apparatus according to this embodiment is provided with an optical sensor (toner quantity detecting unit) 501 instead of the density sensor 500 of the image forming apparatus 100 in the first embodiment.

Figure 5B:
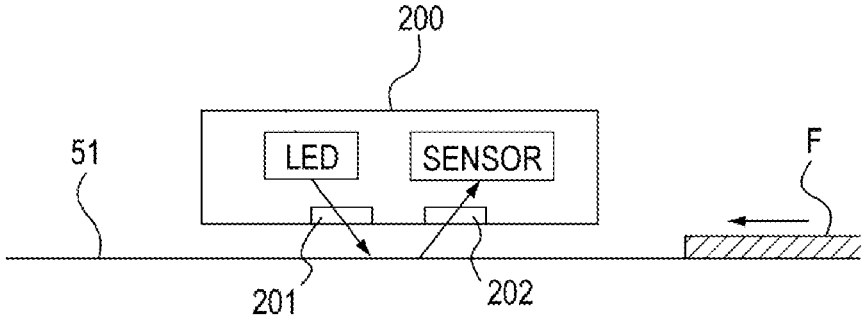
FIG. 5B is a diagram illustrating a configuration of an optical sensor according to the second embodiment.

As illustrated in FIG. 5B, the optical sensor 501 detects the amount of toner by reading a color patch F which is formed on the intermediate transfer belt 51 at the time of starting a print job or between the image forming operations (between sheets). The optical sensor 501 emits infrared light from a light-emitting portion 201, and receives reflected light from the intermediate transfer belt 51 through a detecting surface 202. The detection result is converted into density data using a density conversion table which is verified through an experiment in advance, and then determines whether or not the maximum density is in a predetermined range.

The read toner patch is removed by the intermediate transfer member cleaner 54. With the configuration of forming and reading the toner patch between sheets, the amount of toner can be detected without causing downtime, and there is no need to prepare a separate place for discharging the output material.

The control for changing the image density is performed in the same manner as described in the first embodiment. At the time when the maximum contrast potential departs from a predetermined range, the process enters the color tone stabilizing mode. Therefore, no abnormal image is generated and the variation of a color tone can be reduced.

In addition, there is another method in which a user who cuts an output material at a position of a crossmark formed by punching on a large-sized sheet (for example, 13×19) can detect a density using a density sensor by forming a patch image on an area other than the crossmark area in the same manner of the first embodiment. Even in this method, the amount of toner can be detected without causing downtime, and there is no need to prepare a separate place for discharging the output material.

According to the invention, in a case where the density variation of a development device occurs, the density of the development device is corrected to be equal to that of the other ones. Therefore, the variation of a color tone of an image having high-order colors which is caused by the occurrence of carrier attachment or a different variation ratio of the density of each color can be suppressed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-027155, filed Feb. 10, 2011, which is hereby incorporated by reference herein in its entirety.

What is claimed is:

1. An image forming apparatus comprising:

a first image forming portion provided with a first developing device having a first developer carrier for developing an electrostatic latent image;

a second image forming portion provided with a second developing device having a second developer carrier for developing an electrostatic latent image;

a sensor that detects a toner image for control formed by each of the first and second image forming portions; and a controller that controls a potential difference between a developing bias applied to the developer carrier of each of the first and second image forming portions and a potential of a maximum image density portion of an electrostatic latent image to be developed by each of the first and second developing devices such that respective maximum image density set by each of the first and second image forming portions is within a predetermined target density range based on a density of the toner image for control formed by each of first and second the image forming portions, wherein the controller controls the potential difference such that the potential difference set by each of the first and second image forming portions is within a predetermined range, and in a case that the potential difference of one of the first and second image forming portions is restricted to a highest image density or a lowest image density, the controller changes the respective maximum image density set by the other of the first and second image forming portions based on a maximum image density of the one image forming portion in which the potential difference is restricted.

* * * * *